United States Patent [19]

Lewis et al.

[11] 4,166,030

[45] Aug. 28, 1979

[54] APPARATUS FOR HANDLING SHEETS OF PAPER

[75] Inventors: John B. Lewis, Hemel Hempstead; Roy E. Winchester, St. Albans, both of England

[73] Assignee: De La Rue Crosfield Limited, London, England

[21] Appl. No.: 933,853

[22] Filed: Aug. 15, 1978

[51] Int. Cl.[2] ..... B07C 5/34

[52] U.S. Cl. ..... 209/534; 209/548; 209/551; 209/553; 241/81; 271/64

[58] Field of Search ..... 209/534, 548, 551, 553, 209/569, 583, 900; 241/24, 36, 68, 81, 223, 236; 271/4, 5, 64, 196, 276

[56] References Cited

U.S. PATENT DOCUMENTS

| | | | |
|---|---|---|---|
| 3,023,900 | 3/1962 | Thier | 209/3.2 |
| 3,067,871 | 12/1962 | Lyon et al. | 209/553 |
| 3,252,570 | 5/1966 | Smith | 209/548 X |
| 3,264,630 | 8/1966 | Conklin | 209/548 X |
| 3,300,149 | 1/1967 | Lemardeley et al. | 241/36 |
| 3,710,936 | 1/1973 | Mizunuma | 209/551 X |
| 3,724,766 | 4/1973 | Bosland | 241/36 X |
| 3,759,382 | 9/1973 | Walkley et al. | 209/551 X |
| 3,873,410 | 3/1975 | Chupka | 241/24 X |

*Primary Examiner*—Joseph J. Rolla
*Attorney, Agent, or Firm*—Kane, Dalsimer, Kane, Sullivan & Kurucz

[57] ABSTRACT

A sheet handling apparatus for documents requiring secure handling, such as banknotes. The documents are fed one at a time along a main flow-line in which they are sensed to determine whether they are in a fit condition or in an unfit condition. If unfit, they are routed into a secondary flow-line leading to a shredder, the secondary flow-line including further checking structure to ensure that documents classed as unfit in the main flow-line are present in the secondary flow-line at the appropriate time and are guided to the shredder.

11 Claims, 2 Drawing Figures

APPARATUS FOR HANDLING SHEETS OF PAPER

Figure 1:
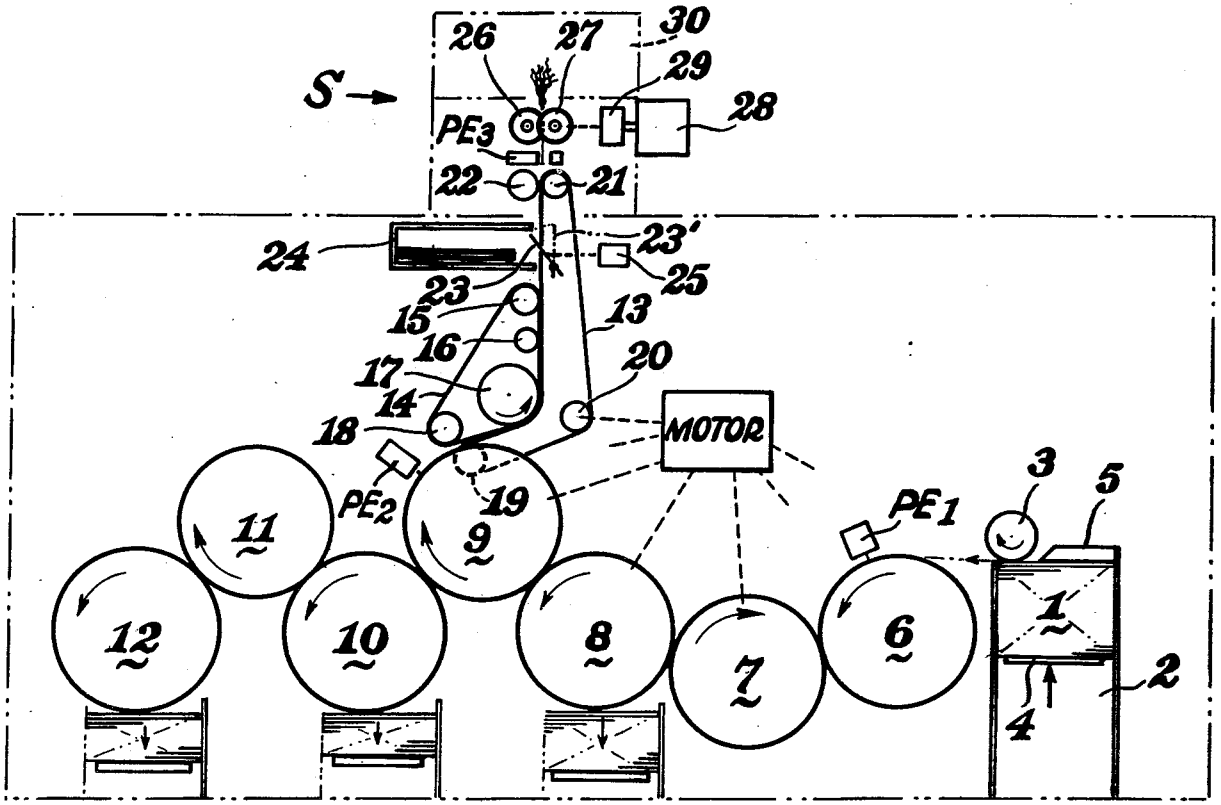

This application is related to the subject matter of application Ser. No. 710,406, now abandoned.

This invention relates to paper sheet handling apparatus of the type which feeds sheets one at a time from a stack of sheets and moves them in spaced relationship along a flow-line to one of several alternative destinations. The sheets pass one or more detector heads at or near the commencement of the flow-line to determine whether the sheets possess a predetermined characteristic, and signals derived from the heads are used to route the sheets to their respective destinations.

The sheets may, for example, include printed matter capable of being read by the detector heads so that the final destination of each sheet depends on the nature or quality of the printed matter. Furthermore, the apparatus may segregate sheets according to their physical condition, for example, to remove soiled or otherwise degraded sheets from a stack containing both new and old condition sheets. In either case the destination of each sheet is selected automatically in accordance with information derived from the detector heads.

One use of apparatus of the above type is in the sorting of security documents, such as banknotes, bonds, warrants, share certificates, vouchers, tickets, coupons, and other documents having a value of any kind in excess of their respective intrinsic values as pieces of paper. Apparatus of the kind described is well known for sorting, from a stack, security documents of different kinds and/or of different conditions, for example, genuineness, quality of print or degree of wear.

One of the problems which occurs in a machine of this type when sorting security documents is that genuine documents which have been rejected because of their physical condition must be removed from the sorting machine and destroyed. This obviously presents a security risk.

In accordance with the present invention sheet handling apparatus comprises means for removing sheets one at a time from a stack and feeding them serially into a main flow-line, means for detecting the presence or absence of a predetermined characteristic of each sheet removed from the stack, means responsive to the output of the detecting means for routing the sheets to a number of alternative destinations, and means for automatically destroying those sheets arriving at a first of the said destinations. This first destination will generally be positioned at the end of a secondary flow-line while the remaining destinations will be spaced at intervals along the main flow-line.

Preferably further detection means are provided in the secondary flow-line to monitor the actual route of each sheet. Signals from the further detection means are then compared with signals derived from the first detection means to determine whether the actual route corresponds to the intended route. In the absence of agreement, corrective and safety devices are selectively actuated to ensure that incorrectly routed sheets not intended for destruction are not inadvertently destroyed.

Preferably the further detection means comprise second and third detectors disposed near the beginning and end of the secondary flow-line, respectively.

Preferably a sheet diverter is placed between the second and third detectors to divert from the secondary flow-line an incorrectly routed sheet detected by the second detector. Conveniently, the diverter comprises a biased, pivotally-mounted blade normally obstructing the secondary flow-line, but movable to a non-obstructing position upon energisation of a powered actuator.

Preferably the means for automatically destroying the sheets comprises an intermeshed rotary cutter which shreds the sheets and which includes a means to detect effective rotation thereof. In the absence of this effective rotation during normal operation, a fault-condition signal is generated which stops the apparatus functioning.

The seconary flow-line is preferably encased to prevent access to sheets passing along it. A fault-condition signal is generated upon the removal or unlocking of any part of the casing during normal operation of the apparatus.

Preferably a counter totalises the number of sheets destroyed by the shredding device.

The secondary flow-line may consist of any suitable arrangement of driven conveying elements, but conveniently, it comprises a pair of opposed traction belts which define a moving nip for positively engaging and transporting the sheets.

Figure 2:
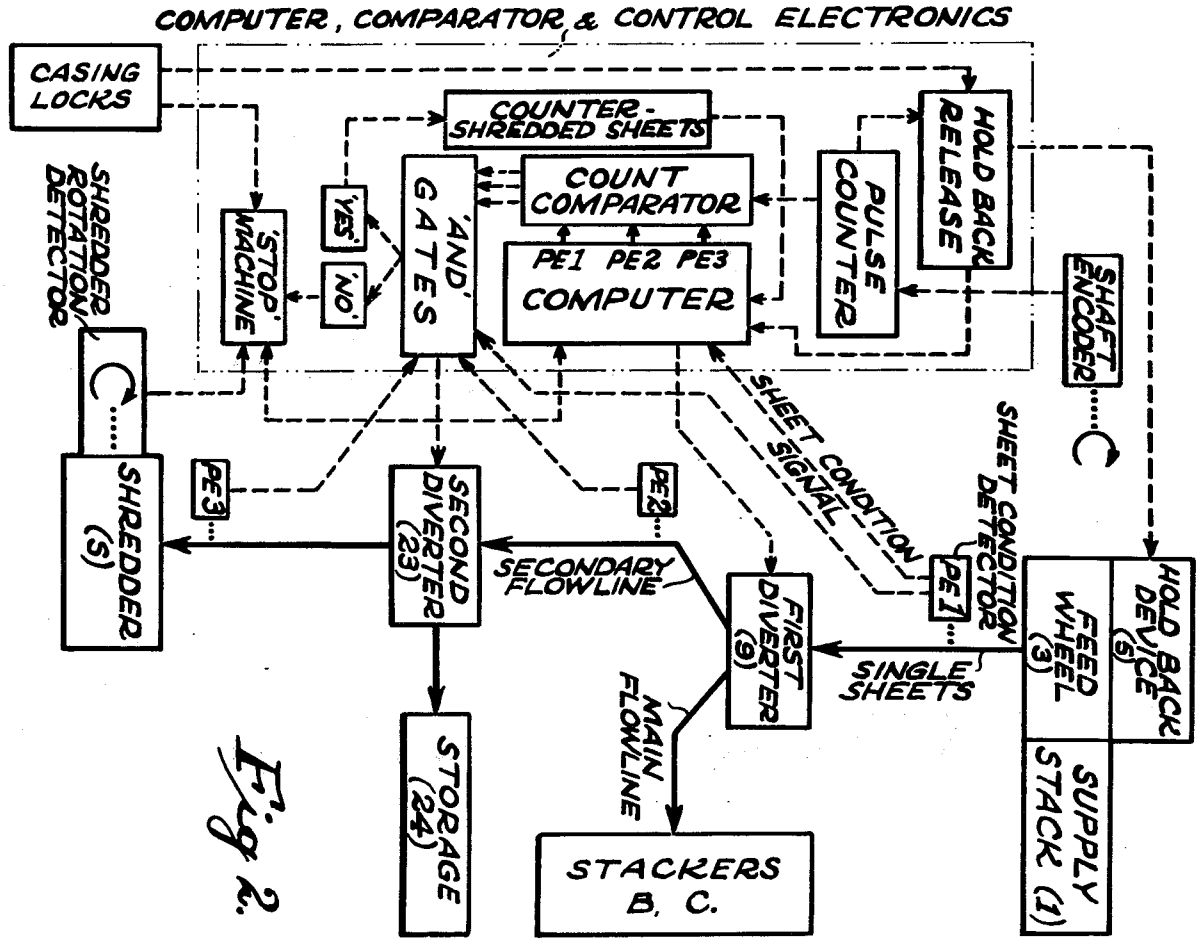

An example of the invention will now be described with reference to the accompanying drawings in which:

FIG. 1 is a diagrammatic plan view showing the essential parts of an apparatus for sorting security documents, for example, banknotes, according to their condition; and FIG. 2 is a flow-diagram illustrating the basic operation of the apparatus shown in FIG. 1.

It should be noted that whilst the document feeding, transporting and stacking means described below specifically relate to a CROSFIELD TYPE 9300 DOCUMENT TRANSPORTER/SORTER, other equivalent known means may alternatively be employed. Accordingly, the description of these mechanisms is brief and refers only to essential components thereof and precise details of structural members, bearing and driving means have been omitted.

The illustrated apparatus feeds the security documents either along a main flow-line into one of three collecting compartments A, B and C at the front of the sorter or, alternatively, diverts them along a secondary flow-line into a shredder, generally indicated by symbol S, disposed at the rear of the apparatus. The particular route of each sheet is dependent on the outputs from a sensing head assembly PE1 of known type which scrutinizes the documents with respect to a desired selection of test parameters of marking or physical condition. The sensing head assembly PE1 also serves as a presence detector, as will be explained below.

Compartment A receives documents which fail to fulfill an authenticity test, regardless of their condition of wear. It is important to retain these documents so that the cause of each failure can be determined. Compartments C and B receive authentic, fit-condition documents for further use. To facilitate the removal of the latter documents, the apparatus delivers batch quantities to compartments C and B alternately, thereby eliminating the need for repetitive starting and stopping of the feeding/transport mechanism. Unfit, but genuine documents, are routed and diverted from the main flow-line to the shredder S for destruction along the secondary flow-line.

The documents are fed one at a time from the front face of a supply stack 1, disposed on edge upon a support platform 2, by means of a radially-ported suction feed wheel 3. The rear face of the stack is biased towards the feed wheel by a spring-loaded pressure member 4. In operation, the wheel 3 is rotated in a clockwise direction and the frontmost document in the stack is removed in a tangential direction across the remainder of the stack. A holding-back suction device, generally indicated by symbol 5, is provided to release, in an intermittent manner, the frontmost document to the effect of the suction wheel thereby to initiate an accurate timing sequence for each document and to create predetermined gaps between successive documents delivered to the flow-line.

The documents are fed seriatim through the sorter along a sinuous main flow-line defined by the partial circumferences of a succession of vacuum transporting drums indicated by numerals 6 to 12, inclusive.

The holding-back device and the transporting drums are geared together in phased relationship, the drive means for which includes a shaft encoder adapted to generate a cyclic train of clock pulses which are fed into a pulse counter (FIG. 2). The progress of each sheet along the flow-line is monitored by comparing the count in the pulse counter with stored datum count values representing the linear distances of photoelectric presence detectors PE1, PE2 and PE3 from the supply stack. Upon the attainment of each of the predetermined pulse counts, the presence or absence of a released sheet at these detectors is determined by reference to the corresponding presence of absence of signals from the detectors. For example, in the case of a document which is present at the sensing head PE1 at the correct time (i.e. when the programmed count is achieved) and which on scrutinization by the sensing head assembly PE1 gives rise to a condition signal which requires the document to move along the secondary flow-line, the condition signal is fed to the computer wherein it enables the datum pulse counts corresponding to pulse detectors PE2 and PE3, to monitor the passage of a document by each of these detectors and thus to verify that the progress of the document is correct with respect to routing, timing and placement.

Each drum comprises a pair of axially spaced discs provided with circumferential vacuum ports in communication with a source of vacuum. A stationary air commutator device serves to apply vacuum to the ports of the discs through a predetermined angle in the direction of rotation thereby to grip and convey each document in turn. By this means a document removed by the suction feed wheel 3 is received by the drum 6 and is thereafter transported to the nip of the drum 7 and thence to one of the four destinations referred to above by one or more of the other transporting drums in a sequential manner. It will be seen from the drawing that drums 8, 10 and 12 additionally serve as stacking drums for the stack collecting compartments A, B and C, respectively. To enable the document to be routed to an intended destination, solenoid-operated air-valves (not shown) are provided to admit and cutoff the supply of vacuum and/or to modify the effective angle of application of the vacuum to certain of the drums in a predetermined manner.

Every document fed from the feed wheel 3 is viewed by the sensing head assembly PE1 and output signals derived therefrom are fed into the computer control electronics (FIG. 2) which in turn, via known electronic means, control the above mentioned air valves and temporarily store information indicative of the status of each document. For reasons of simiplicity, PE1 is shown diagrammatically in the drawing as a single sensing head but in practice it comprises a plurality of independent detectors each adapted to view a selected part of the document or to effect an evaluation in accordance with a predetermined test parameter. To enable the reverse side of a document to be viewed one or more further detectors (not shown) may be provided to view the same while it is being carried by drum 7.

Documents destined for destruction by the shredder S are diverted by a first diverter (drum 9) along the secondary flow-line which comprises the nip formed between a pair of traction belts 13 and 14. Belt 14 is carried upon pulleys 15, 16, 17 and 18 and belt 13 is carried upon pulleys 19, 20 and 21 in the manner shown. Pulleys 17 and 20 are driven from the main driving means for the sorter to provide a linear nip having a speed equal to the peripheral speed of the drum 9.

The pulley 19 is disposed between the discs of the drum 9 to provide a tangential take-off path, and the pulley 21 is journalled in a bracket member (not shown) disposed externally of the casing of the principal structure of the sorter and internally of the casing of the shredder assembly. The latter casing is releasably attached to the former casing by suitable security locking means (FIG. 2) to ensure that external access to unshredded documents is not obtained and to inhibit operation of the entire apparatus if the casing or any detachable part thereof is not securely fastened. Transparent observation windows are provided in the upper surfaces of the casings to permit the passage of documents along the secondary flow-line to be observed.

A freely running guide pulley 22, journalled upon a bracket member (not shown) is provided to form a nip between the end of the belt 13 to ensure that documents are positively fed into the shredder.

Intermediately between the pulleys 15 and 22 there is a second diverter 23 capable of diverting documents from the secondary flow-line to an internal storage compartment 24. The second diverter 23 comprises a pair of pivotally mounted blades adapted to pass across the sides of the belt 13. The blades are spring-biased to an operative position as shown in FIG. 1 thereby to prevent documents from entering into the shredder, and are movable to an inoperative position (see chain-dotted line 23') upon energisation of a solenoid 25. The second diverter thereby fulfils a fail-safe function to ensure that only correctly routed documents are delivered to the shredder. A second photoelectric sensing head PE2 is provided adjacent the input end of the belt 13 to detect the presence of all documents routed to the shredder along the secondary flow-line. The existence of a pulse from PE2 and its timing are used to verify that a document entering the secondary flow-line is correctly positioned and routed.

The shredder S essentially includes a pair of intermeshed multi-grooved cutting cylinder assemblies 26 and 27, disposed on vertical shaft axes which are driven by means of a geared driving motor 28 via an electromagnetic clutch 29. Documents fed into the mesh nip of the cutting cylinders by the belt 13 are shredded into 2.5 mm wide ribbons which are delivered as waste material into a suitable storage compartment, generally indicated by symbol 30. Alternatively, the said waste material may be directed into sacks and the loading thereof may optionally be assisted by pneumatic means.

As an additional security safeguard a further document presence detecting head PE3 is provided between the delivery end of the belt 13 and the nip of the shredder cylinders 26, 27 to monitor the passage of documents into the shredder. PE3 serves a similar purpose to that of PE2 described above and in effect checks, (a) that the quantity of documents actually fed into the shredder agrees with the quantity selected for destruction by the sensing head assembly PE1, (b) that documents destined for the shredder pass completely along the secondary flow-line, (c) that the diverter 23 has not seized in its inoperative position in spite of de-energisation of the solenoid 25, thereby incorrectly routing a document to the shredder, and (d) that a document has entered into the shredder. To effect a still further check on the latter enventuality a rotation-sensitive detection device is provided on one or both of the shredder cylinder shafts to generate a "fault-condition" if a predetermined rotational speed is not attained during normal operation of the apparatus. In practice, the effective nip velocity of the shredder is arranged to be slightly greater than the linear speed of the secondary flow-line to ensure that documents are effectively pulled by the shredder cylinders whilst in a state of slight tension.

The operation of the apparatus illustrated in FIG. 1 will now be described with addition reference to FIG. 2.

During the operation of the apparatus, a train of clock pulses is directed from the shaft encoder into the pulse counter. A holdback release unit sends a signal to the hold-back device 5 to cause it to release a document to the feed wheel 3 and at the same time directs a signal to the computer to indicate that a document has been released and thereby to set up a datum count value for the arrival of the document at the photoelectric assembly PE1. The feed wheel feeds the documents into the main flow-line. On sensing the presence of the documents, the photoelectric assembly PE1 sends a signal to the AND gate circuit. When the count comparator recognises that the count in the pulse counter has reached the stored datum count value for PE1 the comparator supplies a signal to the AND gate circuit, which compares this signal and the pulse from photoelectric assembly PE1 for coincidence. If there is coincidence, the AND gate output verifies that the timing of the arrival of the sheet is correct.

Additionally, PE1 scrutinises the document and generates a sheet condition signal which is fed into the computer to programme the route of the document and to control the first diverter, which is constituted by the drum 9. This diverts "fit" condition documents along the main flow-line and "unfit" condition documents along the secondary flow-line. This diversion is effected by means of a solenoid-operated air flow valve associated with the drum 9 which, for a "fit" document, limits the application of vacuum to the drum to an angle of about 90° thereby to divert the document to stacker B via drum 10 or to stacker C via drums 10 to 12. In the case of an "unfit" document, the vacuum to drum 9 is maintained throughout an angle of approximately 180° whereby the document is diverted into the secondary flow-line to be conveyed to the shredder between the traction belts 13 and 14.

If the output from PE1 has indicated that the document is not authentic, the vacuum supplied to drum 9 is cut off altogether and the document is conveyed by the drum 8 to the stacker A (see FIG. 1). Thus, information indicative of the intended route of a document is stored in the computer and in the case of an unfit document, the computer stores datum count values for the arrival of the document at the presence detectors PE2 and PE3.

When the count comparator recognises that the count in the pulse counter has reached the stored datum value for the presence detector PE2, it sends a pulse to the AND gate circuit. The AND gate circuit is also connected to receive from the presence detector PE2 the pulse representing the arrival of the document at that detector and compares the timing of these pulses. A coincidence results in an AND gate output verifying that the expected document has arrived at the expected time and controlling the operation of the second diverter 23.

If there is agreement between the two signals an output from the computer energises solenoid 25 to withdraw blade 23, but if there is no agreement the solenoid is not energised (or is de-energised during continuous operation) and the sheet is fed into the store 24.

In a similar manner, when the count comparator recognises that the count in the pulse counter has reached the stored datum count value for photoelectric detector PE3, the AND gate circuit receives a pulse from the count comparator. If it does not at the same time receive a pulse from the presence detector PE3, the AND gate circuit generates an output signal which disengages the magnetic clutch 29 to remove the drive to the rotary cutters.

When signals from both PE2 and PE3 are generated at the respective times that the pulse counter reaches the stored PE2 and PE3 datum count values, the document is fed into the shredder for destruction and this event is recorded by a counter-shredded sheets.

Whenever one of the above-described comparisons indicates that the intended route of a sheet does not correspond to the actual route, a "fault-condition" signal is generated. This signal as well as controlling the energistation of solenoid 25 and the engagement of magnetic clutch 29, also instigates a controlled "run-down" of the sorter, which is effected by inhibiting operation of the feed wheel 3 and permitting the documents already travelling along the main flow-line to reach their intended destination. Documents already travelling along the secondary flow-line will be diverted automatically into the compartment 24 by the diverter 23. Restarting of the apparatus is effected by acting upon information derived from the computer control electronics, which may, for example, comprise an instruction to remove specified documents from the storage compartment 24 and position them in the supply stack 1.

It should be noted that upon the creation of any "fault-condition" (whether or not the diverter 23 is actuated) the sorter is subjected to the "run-down" procedure referred to above, thereby to ensure that the apparatus cannot continue to function if a document is not routed in the exact manner as determined by the sensing head assembly PE1.

To provide an overall check of the correct functioning of the apparatus, the total recorded by the counter-shredded sheets is added to the total from counters (not shown) provided at stackers A, B and C and the number of documents diverted into the storage compartment 24, and the resulting grand total is compared with the number of documents fed from the supply stack 1.

It will thus be seen that by means of the above described invention, sheets may be segregated according to their status or condition and thereafter certain of the same may be destroyed automatically as a continuous operation.

A computer which can be used satisfactorily in the present system is a commercially available Honeywell Type 316 computer. Similarly, a commercial detector such as that used for PE1, is obtainable from Erwin Sick trading as Sick Opticeletronik of Waldkirch, West Germany and identified as Type BCE 70. The shaft-encoder is also a commercially available device commonly known in the art and one which will work satisfactorily is obtainable from Muirhead-Vatric Ltd. of Beckenham, Kent, England.

Furthermore, it will be appreciated that when handling sheets having an intrinsic value the associated security and safety means ensure that sheets destined for destruction cannot be illegally removed from the apparatus and that any incorrectly conveyed sheet is immediately detected and operation of the apparatus is arrested.

We claim:

1. Sheet handling apparatus comprising a stack support means for supporting a stack of sheets, a sheet removing means for removing the sheets one at a time from the stack and feeding them serially into a main flow-line, first detection means for detecting the presence or absence of a predetermined characteristic of each sheet fed into the main flow-line and for generating a corresponding output signal representing the intended route of each sheet, means responsive to said output signal for routing said sheets either further along said main flow-line or along a secondary flow-line, second detection means disposed in said secondary flow-line for detecting the passage of sheets along the secondary flow-line, means for storing said output signal from said first detection means, means for subsequently comparing said stored signal with an output from said second detecting means representing the actual route of the sheet and for generating a fault-condition signal whenever said actual route does not correspond to said intended route, sheet diverter means disposed in said secondary flow-line downstream of said second detection means, said diverter means being responsive to said fault-condition signal to divert a sheet from said secondary flow-line, and a shredding device disposed at the end of said secondary flow-line whereby sheets routed along said secondary flow-line in response to said output signal from said first detection means are automatically destroyed unless a fault-condition signal is generated.

2. Apparatus according to claim 1, in which the diverter means comprises a blade-like member arranged, when in an operative position, to divert sheets from the secondary flow-line, biasing means to bias the member to its operative position, and powered means to move the member to an inoperative position free of the flow-line.

3. Apparatus according to claim 1, in which the shredding device comprises a pair of intermeshed rotary cutters, a detection means for detecting effective rotation of the cutters, and means for generating a fault-condition signal when the cutters do not rotate in a predetermined manner during normal operation of the apparatus.

4. Apparatus according to claim 1, including a casing and associated locking means together adapted to prevent access to sheets passing along the secondary flow-line and means for generating a fault-condition signal upon the removal of any part of the casing or unlocking of the locking means during normal operation of the apparatus.

5. Apparatus according to claim 1, including means for arresting effective operation of the sheet removing means and the shredding device in response to the generation of a fault-condition signal.

6. Apparatus according to claim 1 including counting means for counting the number of sheets fed into the shredding device.

7. Apparatus according to claim 1, further comprising third detection means for detecting the presence of a a sheet along the secondary flow-line downstream of the sheet diverter means, second means for comparing the output from said third detecting means with the stored signal and means for stopping the apparatus when the output of said second comparing means indicates a discrepancy between the actual route of a sheet and the intended route.

8. Apparatus according to claim 1, in which the sheets are transported along the main flow-line by a succession of sheet-transporting elements, one of the elements being switchable between a first state and a second state depending on the output of the first detection means, the sheets being transported further along the main flow-line when the element is in its first state and being diverted into the secondary flow-line when the element is in its second state.

9. Apparatus according to claim 8, in which the elements comprise vacuum drums, the switchable element transporting a sheet around a first predetermined portion of its periphery in its first state and around a second predetermined portion of its periphery when in its second state.

10. Sheet handling apparatus comprising a stack support means for supporting a stack of sheets, a sheet removing means for removing the sheets one at a time from the stack and feeding them serially into a main flow-line, first detection means for detecting the presence or absence of a predetermined characteristic of each sheet fed into the main flow-line and for generating a corresponding output signal representing the intended route of each sheet, means responsive to said output signal for routing said sheets either further along said main flow-line or along a secondary flow-line, means for storing said output signal from said first detection means, second detection means disposed in said secondary flow-line for detecting the passage of sheets along the secondary flow-line, means for comparing said stored signal derived from said first detecting means with an output from said second detecting means and for generating a fault-condition signal in the absence of agreement between said compared signals, sheet diverter means disposed in said secondary flow-line downstream of said second detection means, said diverter means being responsive to said fault-condition signal to divert from said secondary flow-line a sheet responsible for the signal from the said detecting means which gave rise to the fault condition signal, third detection means for detecting the presence of a sheet along the secondary flow-line downstream of the sheet diverter means, means for comparing the output from said third detecting means with the stored signal to generate a fault-condition signal in the absence of agreement between the compared signals, and a shredding device disposed at the end of said secondary flow-line whereby sheets routed along said secondary flow-line in response to said output signal from said first detection means are automatically destroyed unless a fault-condition signal is generated.

11. Apparatus for destroying unfit condition sheets contained in a stack of mixed fit and unfit sheets, comprising a stack support means for supporting a stack of sheets, a sheet removing means for removing the sheets one at a time from the stack and feeding them serially into a main flow-line, first detection means for scrutinising the sheets and to generate either a fit or unfit decision signal thereby to establish an intended route for each sheet, sheet switching means under the control of said first detection means for routing a fit sheet further along said main flow-line or an unfit sheet along a secondary flow-line, second detection means for detecting sheets passing along the secondary flow-line and for creating a fault-condition signal upon the passage of a sheet detected by said first detection means as a fit sheet, sheet diverter disposed in said secondary flow-line downstream of said second detection means to divert from said secondary flow-line a sheet upon the creation of a fault-condition signal, and a shredding device disposed at the end of said secondary flow-line to destroy sheets passing completely therealong.

* * * * *